United States Patent [19]

Honda

[11] 4,131,359

[45] Dec. 26, 1978

[54] SENSITIVE MEDIUM CLEANER FOR USE IN ELECTROPHOTOGRAPHIC COPYING MACHINE

[75] Inventor: Ko Honda, Ebina, Japan

[73] Assignee: Rank Xerox Limited, London, England

[21] Appl. No.: 791,355

[22] Filed: Apr. 27, 1977

[30] Foreign Application Priority Data

Apr. 28, 1976 [JP] Japan ..... 51/052503[U]

[51] Int. Cl.[2] ..... G03G 21/00; G03G 15/10

[52] U.S. Cl. ..... 355/15; 15/256.52; 118/652

[58] Field of Search ..... 355/3 R, 15; 118/652; 15/256.51, 256.52

[56] References Cited

U.S. PATENT DOCUMENTS

| | | | |
|---|---|---|---|
| 3,693,547 | 9/1972 | Morgan | 15/256.52 X |
| 3,740,864 | 6/1973 | Ito et al. | 355/15 |
| 3,766,592 | 10/1973 | Suzuki | 15/256.51 |
| 3,927,937 | 12/1975 | de Keyzer | 118/652 X |
| 4,056,315 | 11/1977 | Ariyama et al. | 118/652 X |

*Primary Examiner*—Fred L. Braun

[57] ABSTRACT

A copying apparatus wherein the cleaning unit of the apparatus includes a blade and a collecting roller. The cleaning unit is arranged for movement toward and away from the imaging surface. Apparatus are provided for continuing the rotation of the collecting roller after the copying apparatus has stopped and in response to the movement of the collecting roll and blade away from the imaging surface.

2 Claims, 4 Drawing Figures

SENSITIVE MEDIUM CLEANER FOR USE IN ELECTROPHOTOGRAPHIC COPYING MACHINE

BACKGROUND OF THE INVENTION

The present invention relates to a sensitive medium cleaner for use in an electrophotographic copying machine. More particularly it is directed to an improvement wherein a cleaning unit, which is equipped with a cleaning blade for scraping off post-development toner from a sensitive medium and a conveying roller for collecting the toner into a collection sump, is pressed against the sensitive medium with a fixed pressure only during the operation of the copying machine or is separated from the sensitive medium surface at the stop of the copying machine.

In the conventional sensitive medium cleaners having a cleaning blade and a conveying roller pressed against the surface of a sensitive medium, the sensitive medium can be stopped at a position wherein the cleaning blade and conveying roller come to rest against portions of the sensitive medium which do not image the copy paper. In an alternative copying machine the cleaning blade alone is pressed against the sensitive medium during the copying machine operation. The conveying roller is disposed spaced from the sensitive medium surface and is charged at a polarity opposite to that of the toner so as to attract the toner electrostatically for collection. With the sensitive medium cleaner of such a machine, there exist disadvantages including high manufacturing cost.

U.S. Pat. Nos. 3,740,789 to Ticknor and 3,871,762 to Ulasakker are illustrative of sensitive medium cleaners employing a cleaning blade and collecting roller.

SUMMARY OF THE INVENTION

The present invention has as its object the provision of an improved sensitive medium cleaner for use in an electrophotographic copying machine. A cleaning blade and a conveying roller are brought into contact with the sensitive medium by a pressure mechanism preferably only during the operation of the copying machine. They are separated from the sensitive medium when the copying machine stops. A mechanism is provided for preventing the residual toner from falling off the conveying roller at the time of separation of the cleaning unit from the sensitive medium and for collecting the toner automatically into a collection sump.

DETAILED DESCRIPTION OF THE PREFERRED EMBODIMENTS

Figure 1:
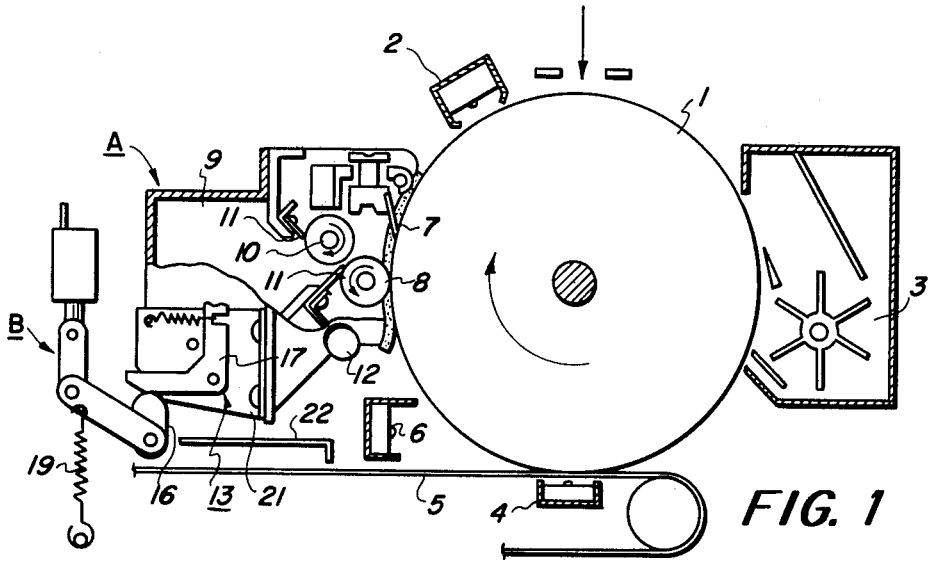
FIG. 1 is an overall schematic sectional view of a copying machine of this invention.

The present invention will now be described in detail with reference to an exemplary embodiment illustrated in the accompanying drawings. A charging corotron (corona generator) 2 is located obliquely above a sensitive medium 1 of the electrophotographic copying machine. When exposure is effected, an electrostatic latent image is formed on the sensitive medium surface 1 which was charged by the corotron 2. The latent image is developed with a toner in a developing processor 3. The image thus developed is transferred onto a copy sheet 5 by means of a transfer corotron 4 disposed below the copy sheet 5. The image is then fixed in a fixer (not shown).

The toner remaining on the surface of the sensitive medium 1 is neutralized electrostatically by a cleaning corotron 6. Subsequently it is scraped from the sensitive medium 1 by a cleaning blade 7 which is in sliding contact with the sensitive medium 1. Thus, the toner falls onto a conveying roller 8 which is disposed in a cleaning unit A supported swingably about shaft 12. While being kept in intimate contact with the sensitive medium 1, the conveying roller 8 is rotated in the opposite direction and serves to convey and collect the toner into a collection sump 9 located behind the cleaning unit A.

A pressure or pinch roller 10 is disposed in the proximity of the conveying roller 8 so as to efficiently convey the toner into the collection sump 9. Blades 11 are in sliding contact with the circumferential surfaces or conveying roller 8 and pressure roller 10, respectively, to scrape off the toner adhering thereto and to prevent counterflow of the toner toward the sensitive medium 1.

Behind the cleaning unit A equipped with the cleaning blade 7 and conveying roller 8 and pressure roller 10, a pressure mechanism 13 is installed for biasing the cleaning unit A with a pressure toward the sensitive medium 1. A cleaning-unit engaging/disengaging mechanism B supported by the frames 14*a* and 14*b* of the copying machine is located below the pressure mechanism 13. During the operation of the copying machine shown in FIG. 1, an electromagnetic solenoid 15 contained in the engaging/disengaging mechanism B is energized to rotate a set cam 16 in a manner to bring it into contact with a lever 17 of the pressure mechanism 13 in the cleaning unit A. The cleaning unit A is biased toward the sensitive medium 1 by a spring 18 connected to the lever 17, thereby pressing the conveying roller 8 and the cleaning blade 7 against the sensitive medium 1 with a fixed pressure.

Figure 2:
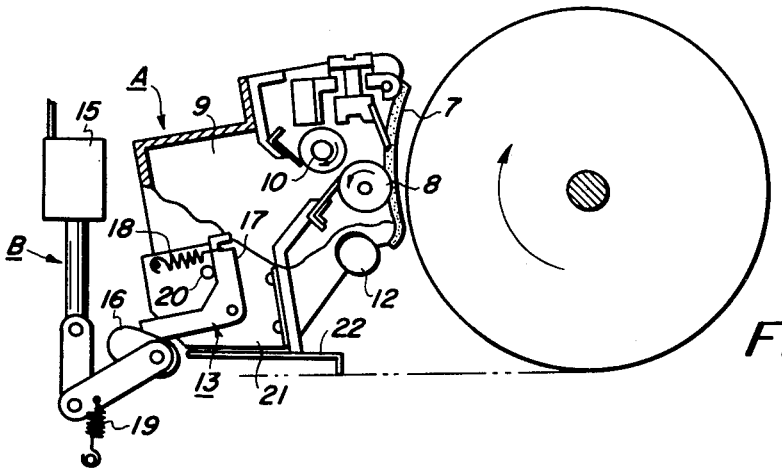
FIG. 2 is a partial sectional view of a cleaner of this invention with the copying machine stopped.

FIG. 2 illustrates the position of the cleaner when the copying machine is stopped. The electromagnetic solenoid 15 of the engaging/disengaging mechanism B is deenergized so that the set cam 16 is rotated to provide a backward inclination by the action of a spring 19 provided at a lower position. Thus, the cam 16 is disengaged from the level 17 of the pressure mechanism 13 in the cleaning unit A. The lever 17 recedes to the position of a stopper 20 by the elastic force of spring 18 and then comes to a stop. Simultaneously the cleaning unit A is swung by its weight of gravity around the support shaft 12 up to a position where a bracket 21 of the pressure mechanism 13 comes into contact with a guide plate 22 located in the copying machine, so that the cleaning blade 7 and the conveying roller 8 are separated from the surface of sensitive medium 1.

In the position illustrated in FIG. 2, the cleaning unit A can be easily unloaded from the copying machine by sliding it on the guide plate 22.

Figure 4:
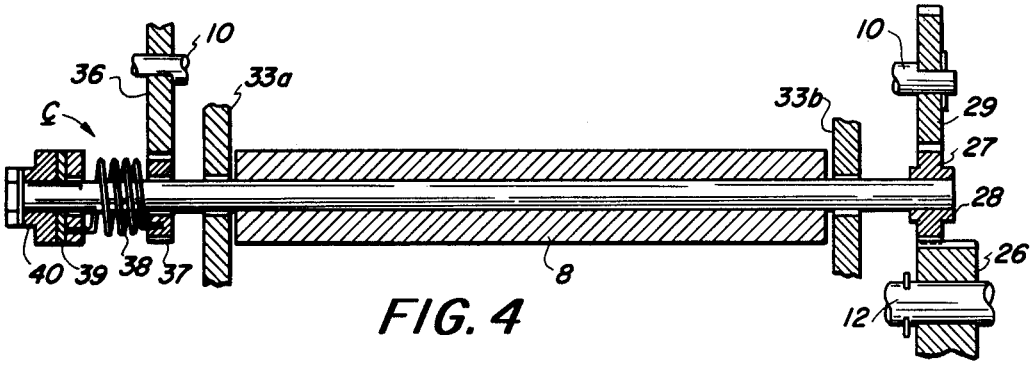
FIG. 4 is a partial sectional view of the cleaner of FIG. 1.
Figure 3:
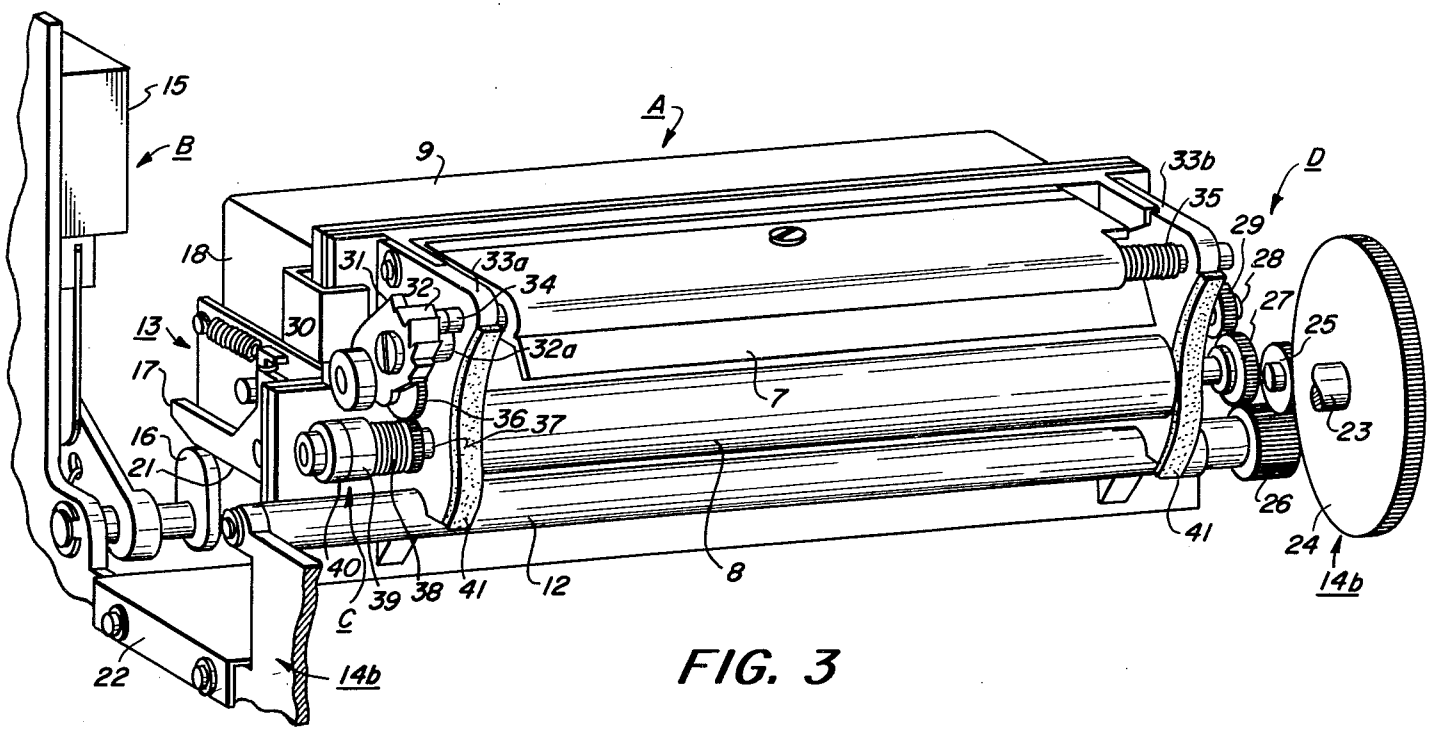
FIG. 3 is a perspective view of the cleaner of FIG. 1.

The following mechanisms are installed for the purpose of preventing the residual toner from falling off the conveying roller 8 between the conveying roller and the sensitive medium 1 when the cleaning unit A is separated from the sensitive medium surface. Prior to explaining the toner-fall preventive mechanism C with reference to FIGS. 3 and 4, a detailed description will be given of a drive transmission mechanism D of the cleaning unit A. A drive gear 24 is mounted fixedly on a sensitive-medium rotating shaft 23, which is supported between frames 14*a* and 14*b* of the copying machine, so as to be rotated together with the sensitive medium 1. The resulting rotation of drive gear 24 is transmitted to a gear 27 on the extension shaft of conveying roller 8 in the cleaning unit A by means of a transmission gear 25 and another transmission gear 26 on the support shaft 12 of cleaning unit A. Thus, the rotation of conveying roller 8 is reversed with respect to that of sensitive medium 1 by the transmission gears 25 and 26, so that the conveying roller 8 and the sensitive medium 1 come to rotate in the same direction at the point of contact.

The gear 27 mounted on the shaft of conveying roller 8 is in engagement with a gear 29 on the shaft of pressure roller 10 on a side plate 33*b* of cleaning unit A and functions to rotate the pressure roller 10 in the direction opposite to that of conveying roller 8. This effects forced collection of the toner into a collection sump 9 by means of the conveying roller 8 and the pressure roller 10. An eccentric cam 30 is mounted fixedly on the shaft of pressure roller 10 at side plate 33*a* and is rotated together with the pressure roller 10. The eccentric cam 30 is equipped with a rotatable pawl 31 which serves to convert the rotation of the cam 30 into reciprocation so as to cause intermittent rotation of a ratchet wheel 32 located at the side plate 33*a*. The ratchet wheel 32 is inclined on the reverse side of the illustration. One end of a cleaning-blade support shaft 34 which is held shiftably between the side plates 33*a* and 33*b* is kept in contact with an inclined surface 32*a* of ratchet wheel 32. The cleaning blade 7 is moved in parallel with the sensitive medium 1 by the elastic force of a compression spring 35 on the side plate 33*b* supporting the cleaning-blade support shaft 34, and by the intermittent rotation of ratchet wheel 32, thereby enhancing the cleaning effect.

With the provision of the above transmission mechanism alone, however, the residual toner of the conveying roller 8 might fall off between conveying roller 8 and sensitive drum 1 when the cleaning unit A is separated from sensitive medium 1 by electromagnetic solenoid 15 at the end of the copying machine operation. To ensure prevention of such falling off of the residual toner, a toner-fall preventive mechanism C is installed which is capable of rotating the conveying roller 8 independently, for collection of the residual toner into the collection sump 9 even after the drive gear 24, and the copying machine operation have stopped. In this toner-fall preventive mechanism, a one way clutch 28 is interposed between the gear 27 and the shaft of conveying roller 8 at the side plate 33*b* of cleaning unit A. When the gear 27 ceases to rotate upon the stop of drive gear 24 occurring simultaneously with the stop of copying machine, the conveying roller 8 is rendered rotatable only in the direction of the normal operation. Since the one way clutch 28 is urged in its locking direction during the copying machine operation, the driving force from the drive transmission mechanism C is transmitted to the conveying roller 8.

A gear 37 is mounted rotatably on the shaft of conveying roller 8 at the side plate 33*a* in engagement with a stationary gear 36 on the shaft of pressure roll 10. The number of teeth of the gear 37 is less than that of the gear 36, while the gears 27 and 29 have the same number of teeth. Therefore, the speed of rotation of the gear 37 is slightly higher than that of the conveying roller 8.

One end of a helical spring 38 is anchored to the gear 37, while the other end thereof is anchored to a cork slip clutch plate 39 disposed rotatably on the conveying roller 8. The cork slip clutch plate 39 is so set as to provide a slide torque F*a* to a slide plate 40 attached fixedly to the shaft of conveying roller 8.

Upon starting the copying machine operation, the electromagnetic solenoid 15 is first energized to actuate the set cam 16 and the pressure mechanism 13, thereby biasing the cleaning unit A toward the sensitive medium 1. The cleaning unit A is pivoted to a position where the conveying roller 8 is pressed against the sensitive medium 1 with a fixed pressure by the spring 18 of pressure mechanism 13. The peripheral speed of conveying roller 8 is so set as to be equal to that of the sensitive medium 1 through selection of the diameter of conveying roller 8 and the gears 24, 25, 26 and 27 of drive transmission mechanism C. A contact resistance F*b* is generated due to the contact between the sensitive medium 1 and the conveying roller 8 of the rubber material. The aforementioned helical spring 38 is wound with the copying machine operation by three or four turns until the slide torque F*a* of cork slip clutch plate 39 is attained. The slide plate 40 and cork clutch plate 39 start slidng when the slide torque F*a* coincides with the drive torque F*c* of the drive transmission mechanism C on the copying machine side.

The drive torque F*d* of cleaning unit A is selected to be smaller than the slide torque F*a* of the cork clutch plate 39. The load per turn of helical spring 38 is selected to be equal to the drive torque F*d*. With regard to the slide torque F*a* of cork clutch plate 39 and slide plate 40, the contact resistance F*b* of conveying roller 8 and sensitive medium 1, the drive torque F*c* of cleaning unit A, and the cleaner drive torque F*b* on the copying machine side, they are related as follows: $Fd > Fb > Fa > Fc$.

When the copying machine is brought to a stop upon termination of one copy cycle, the electromagnetic solenoid 15 is deenergized, so that the set cam 16 is moved backward by the spring 19 and the cleaning unit A is separated from the sensitive medium 1 by its weight of gravity. At this moment, the contact resistance F*b* of conveying roller 8 and sensitive medium 1 is suddenly decreased so that $Fb \div 0 < Fa$. F*b* becomes smaller than F*a* prior to complete separation of the conveying roller 8 from the sensitive medium.

Although the gear 27 on the side plate 33*b* of conveying roller 8 is in engagement with the transmission gear 26, the conveying roller 8 is rendered rotatably only in the direction of the normal operation of the unidirectional clutch 28 even after the stop of the copying machine operation. Accordingly, the load of three or four turns accumulated in the helical spring 38 is exerted in that direction where the helical spring 38 is unwound by two or three turns until the one-turn load equivalent to the drive torque F*c* of cleaning unit A is left. Therefore, the conveying roller 8 makes two or three rotations independently, and thus the residual toner on the conveying roller 8 is collected into the collection sump 9 at the stop of the copying machine operation.

As described in detail hereinabove, the present invention is equipped with the toner-fall preventive mechanism C in which driving energy independent of the copying machine operation is accumulated on the shaft of toner conveying roller 8 in the cleaning unit A so that the conveying roller 8 is rendered capable of making several rotations independently after the copying machine has stopped. By virtue of such provision, when the cleaning unit A is separated from the sensitive medium 1 at the stop of the copying machine, the residual toner on the conveying roller 8 can be collected completely into the collection sump 9 without falling into the copying machine. With a sensitive medium cleaner that collects the toner while keeping the sensitive medium 1 and the conveying roller 8 in contact with each other, the cleaning unit A is engageable with or disengageable from the sensitive medium 1 as desired, thereby achieving prevention of deformation and deterioration of the sensitive medium surface which are otherwise caused by the contact of conveying roller 8 and cleaning blade 7 thereto at the stop of the sensitive medium.

It is apparent that there has been provided in accordance with this invention a sensitive medium cleaner for use in electrophotographic copying machines which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A copying apparatus having a cleaning unit for removing toner from the surface of a sensitive imaging medium comprising:

a cleaning blade for removing toner from said surface;

a toner collection member with a collection roll for receiving toner removed by said blade and a pinch roll cooperating with said collection roll to define a nip comprising an entrance to a toner collection sump;

drive means for driving said collection roll and said pinch roll in a first movement to transport the toner removed by said blade away from said surface toward said collection sump;

means for supporting said blade and said collection roll in a housing for a second, pivotal, movement toward and away from said surface between respective operative and inoperative positions;

means for automatically providing said second, pivotal, movement of said blade and said collection roll away from said surface at the completion of a copying operation in response to the non-operation of said copying apparatus;

toner fall preventing means responsive to said second movement of said blade and said collection roll away from said surface for continuing said first movement of said collection roll to continue the transporting of toner by said collection roll away from said surface during said second movement of said blade and said collection roll away from said surface, said toner fall preventing means including energy accumulation means comprising a spring associated with said drive means for said collection roll and means for loading said spring during operation of said copying apparatus to accumulate energy from said drive means and for unloading said spring after said apparatus has stopped operating for applying said accumulated energy to said collection roll to continue said first movement thereof after the stopping of the copying apparatus, and said toner fall preventing means further including selective coupling means for selectively coupling said spring to said collection roll as it is unloaded to provide said continued first movement.

2. An apparatus as in claim 1, wherein said first movement comprises rotation of said collection roll in a first direction, and wherein said collection roll is supported in said housing by a one-way clutch which prevents is from rotating counter to said first direction, and wherein said selective coupling means comprises a slip clutch.

* * * * *